US005314660A

United States Patent [19]

Clark et al.

[11] Patent Number: 5,314,660

[45] Date of Patent: May 24, 1994

[54] USE OF CATIONIC ALKYL-PHOSPHONIUM SALTS AS CORROSION INHIBITORS IN OPEN RECIRCULATING SYSTEMS

[75] Inventors: Brian E. Clark, Aurora; Ronald L. Oleka, Oakville, both of Canada

[73] Assignee: Grace Dearborn Inc., Mississauga, Canada

[21] Appl. No.: 10,201

[22] Filed: Jan. 28, 1993

[30] Foreign Application Priority Data

Feb. 14, 1992 [CA] Canada ..... 2061249-5

[51] Int. Cl.[5] ..... C23F 11/00

[52] U.S. Cl. ..... 422/15; 422/7; 422/14; 252/389.24; 252/400.24

[58] Field of Search ..... 422/7, 14, 15; 210/764, 210/699; 252/389.24, 400.24

[56] References Cited

U.S. PATENT DOCUMENTS

| | | | |
|---|---|---|---|
| 4,835,143 | 5/1989 | Donofrio et al. | 210/764 |
| 4,835,144 | 5/1989 | Whitekettle et al. | 210/764 |
| 5,010,066 | 4/1991 | Donofrio et al. | 210/764 |

*Primary Examiner*—Timothy M. McMahon
*Attorney, Agent, or Firm*—James P. Barr

[57] ABSTRACT

A method for inhibiting corrosion of metals which are in contact with an aqueous system comprising adding to the system, either alone or in combination with organic or metal containing water treatments, a water-soluble cationic alkyl-phosphonium salt in an amount effective to inhibit corrosion.

10 Claims, No Drawings

USE OF CATIONIC ALKYL-PHOSPHONIUM SALTS AS CORROSION INHIBITORS IN OPEN RECIRCULATING SYSTEMS

FIELD OF THE INVENTION

This invention relates to a method for inhibiting or preventing corrosion of metal surfaces which are in contact with aqueous systems. More specifically, this invention relates to a method wherein a cationic alkyl-phosphonium salt is added to an aqueous system in an amount effective to inhibit the corrosion of an iron-based or yellow metal which is in contact with the aqueous system.

BACKGROUND OF THE INVENTION

Iron and iron-based metal alloys such as mild steel as well as copper and other yellow-metal alloys are well known materials used in constructing the circulating pipes and devices in aqueous systems. Typical devices include evaporators, single and multi-pass heat exchangers, cooling towers, and associated equipment, and the like. As the system water circulates through the system it passes over or through the iron-based or yellow-metal devices, and a portion of the system water evaporates causing an increase in concentration of the dissolved salts and minerals in the water. These salts and minerals approach and reach a concentration at which they may cause severe pitting and corrosion which eventually requires replacement of the iron-based or yellow-metal parts. Various corrosion inhibitors have been previously used.

Chromates and inorganic phosphates or polyphosphates have been used to inhibit the corrosion of metals which is experienced when metals are brought into contact with an aqueous system. The chromates, while effective, are highly toxic and thus present handling and disposal problems. Phosphates are nontoxic, however, due to the limited solubility of calcium phosphate, it is difficult to maintain adequate concentrations of phosphates in systems containing dissolved calcium salts. The polyphosphates are also relatively non-toxic, but then tend to hydrolyze to form orthophosphate which, like phosphate itself, can create scale and sludge problems in the form of calcium phosphates.

N-Tributyl Tetradecyl Phosphonium Chloride (TTPC) has been used previously as an antibacterial and biocide agent for use in water treatment systems (Canadian Patents No. 1,262,084 and 1,262,667, U.S. Pat. Nos. 4,835,143, 4,835,144, and 5,010,066). These patents do not teach the addition of cationic alkyl-phosphonium salts as corrosion inhibitors for ferrous and copper containing alloys in aqueous systems as an individual corrosion inhibiting component or in conjunction with other commonly used corrosion inhibitors.

SUMMARY OF THE INVENTION

It is an object of this invention to provide a method for inhibiting or preventing corrosion of iron-based metals in contact with aqueous systems.

It is another object of this invention to provide a method for inhibiting or preventing corrosion of yellow metals in contact with an aqueous system.

In accordance with the present invention, there has been provided a method for inhibiting corrosion of metals which are in contact with an aqueous system by adding to the system, in a corrosion inhibiting amount, water-soluble cationic alkyl-phosphonium salt having the formula:

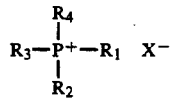

wherein $R_1$, $R_2$, $R_3$ and $R_4$ are independently selected from $C_1$ to $C_{18}$ alkyl, $C_5$ to $C_7$ cycloalkyl, or aryl.

DETAILED DESCRIPTION

It has now been discovered that addition of a water-soluble, cationic alkyl-phosphonium salt to an aqueous system results in a decrease in the corrosion rate of the metal surface which is in contact with the aqueous system. The present invention is thus directed to a novel method for inhibiting or preventing corrosion of metal surfaces which are in contact with aqueous systems which comprises adding to the system a corrosion inhibiting amount of a water-soluble, cationic alkyl phosphonium salt having the formula:

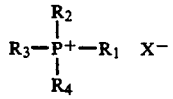

wherein $R_1$, $R_2$, $R_3$, and $R_4$ are each independently selected from the group consisting of $C_1$ to $C_{18}$ alkyl, $C_5$ to $C_7$ cycloalkyl or aryl, and wherein X may be any anion, preferably halide, alkosulfate, tosylate, carboxylate, sulfonate, sulfate, phosphate, phosphonate, acetate, or nitrate. For purposes of this invention, the terminology "water soluble" cationic alkyl phosphonium salt, shall refer to those cationic alkyl phosphonium compounds which are perhaps not fully water-soluble, but are at least partially water soluble such that they may be solubilized in an aqueous system in concentrations of at least 20 ppm, preferably at least 100 ppm. Thus, $R_1$, $R_2$, $R_3$ and $R_4$ are selected such that the resultant phosphonium salt is soluble in an aqueous system in the foregoing concentrations and are generally selected such that $R_1$, $R_2$ and $R_3$ are lower alkyl groups such as, e.g. $C_1$ to $C_6$ alkyl. It is, of course, understood by those of ordinary skill in the art that the solubility of the alkyl phosphonium salts of this invention may be enhanced by first solubilizing the salt in a lower polarity, water-miscible solvent, such as, e.g., alcohol, and then this solution may then be further diluted with water to prepare a final aqueous solution containing the appropriate dosage amount for the system being treated.

Thus, the preferred compounds of this invention, i.e., having the above "water soluble" criteria, and having the above formula, include those cationic alkyl phosphonium salts wherein $R_1$, $R_2$ and $R_3$ are independently selected from the group consisting of $C_1$ to $C_5$ alkyl, preferably $C_3$ to $C_4$ alkyl, and wherein $R_4$ is an alkyl group having at least 12 to 18 carbon atoms, preferably 14 carbon atoms. In a most preferred embodiment the water-soluble, cationic alkyl phosphonium salt is N-tributyl tetradecyl phosphonium chloride (TTPC).

The aqueous systems which may advantageously be treated with the water-soluble cationic alkyl phosphonium salts of this invention include, but are not limited to cooling water systems such as e.g. cooling towers, desalinization units, gas scrubbers, as well as other recirculating water systems where corrosion is known to occur. The present invention is particularly useful in the treatment of cooling water systems which operate at temperatures between 60° F. and 200° F., particularly open recirculating cooling water systems which operate at temperatures from about 80° F. to 150° F.

The precise dosage of the corrosion inhibiting agents of this invention can vary widely depending to some extent on the nature of the aqueous system and the degree of protection required. In general, however, the concentration of the water-soluble cationic alkyl phosphonium salts maintained in the system can be from about 0.1 ppm to about 500 ppm. Within this range, generally low dosages of between 1 ppm and 100 ppm, preferably 2 ppm and 50 ppm, with a dosage in the range of 10 ppm to 20 ppm being most preferred. The exact amount required with respect to a particular aqueous system can be readily determined by one of ordinary skill in the art in conventional manners.

The corrosion inhibitors of this invention may be added to the aqueous system by any convenient mode, such as by first forming a concentrated solution of the treating agent with water or other suitable water-miscible solvent, preferably containing between 1 and 50 total weight percent of the cationic alkyl phosphonium salt, and then feeding the concentrated solution to the system water at some convenient point in the system. In many instances the treatment agent may be added to the make-up water or feed water lines through which water enters the system.

The corrosion inhibitors of this invention may be used as the sole corrosion inhibitor for the aqueous system, or other conventional corrosion inhibitors may also be used in combination therewith. In addition, the cationic alkyl phosphonium salts may be used in combination with other conventional water treating agents including, but not limited to, scale inhibitors, pH regulators, biocides, dispersants, chelants, sequestering agents, polymeric agents, and the like.

Without further elaboration, it is believed that one of skill in the art, using the preceding detailed description, can utilize the present invention to its fullest extent.

The following examples are provided to illustrate the invention in accordance with the principles of this invention, but are not to be construed as limiting the invention in any way except as indicated in the appended claims. All parts and percentages are by weight unless otherwise indicated.

EXAMPLE 1

Tests 1 and 2 show the corrosion behavior of an industrial aqueous recirculating system (pH=7.8, Cl=200 ppm as Cl, $SO_4$=3400 ppm, Total Hardness=3300 ppm as $CaCO_3$, M-alkalinity=180 ppm as $CaCO_3$) treated with and without additions of a water-soluble cationic alkylphosphonium salt, specifically tri-n-butyl, tetradecyl phosphonium chloride (TTPC). The corrosion rates were determined using mild steel coupons over a test period of 14 days as measured by an instantaneous corrosion rate probe. In Test 2, TTPC was added to the recirculating system at a dosage of 15 ppm on a periodic basis.

| Test | Treatment | Corrosion Rate (MPY) Mild Steel |
|---|---|---|
| 1 | No TTPC | 12.1 |

-continued

| Test | Treatment | Corrosion Rate (MPY) Mild Steel |
|---|---|---|
| 2 | With TTPC | 0.91 |

EXAMPLE 2

Tests 1 and 2 show the corrosion inhibitor behavior of an industrial open aqueous recirculating system (pH=7.5-8.3, Cl=280 as Cl, $SO_4$=1221 ppm, Zinc=0-.1-2.0 ppm as Zn) with and without additions of a cationic alkyl-phosphonium salt, specifically TTPC. Corrosion rates were determined using mild steel coupons over a test period of 30 days. TTPC was slug-fed into the recirculating system on a semi-regular basis to obtain a TTPC concentration of 15 ppm.

| Test | Treatment | Corrosion Rate (MPY) Mild Steel |
|---|---|---|
| 1 | No TTPC | 11.2 |
| 2 | With TTPC | 1.71 |

The results of the field tests in Examples 1 and 2 indicate that additions of a cationic alkyl-phosphonium salt provide corrosion inhibition of ferrous alloys components present in open recirculating water. Based on these surprisingly unexpected favorable results, further work was undertaken to assess the corrosion inhibition properties of cationic alkyl-phosphonium salts under laboratory and pilot testing conditions.

EXAMPLE 3

The purpose of this test was to study the effect of cationic alkyl-phosphonium salts, specifically TTPC, alone using the test water described with no other anti-corrosion water treatments. These examples were carried out in a laboratory corrosion assessment test units using Lake Ontario tapwater (100 ppm calcium hardness, 45 ppm magnesium hardness, 88 ppm M-alkalinity at pH of 7.5). The temperature of the water was maintained at 23° C. Both mild steel and copper coupons were connected to a mechanical stirring device, resulting in a coupon velocity of 1 foot per second in the test solution. The test lasted two days. The results of the tests are shown in the following table:

| Test | Coupon Type | TTPC Dosage (ppm) | Corrosion Rate MPY |
|---|---|---|---|
| 1 | Mild Steel | 0 | 10.0 |
| 2 | Mild Steel | 5.0 | 8.2 |
| 3 | Mild Steel | 10.0 | 8.3 |
| 4 | Mild Steel | 15.0 | 5.9 |
| 5 | Mild Steel | 20.0 | 6.2 |
| 6 | Copper | 0 | .35 |
| 7 | Copper | 10 | .22 |
| 8 | Copper | 20 | .20 |

These tests demonstrate that additions of cationic alkyl-phosphonium salts, when used as the sole corrosion inhibitor, effectively inhibited corrosion in mild steel and copper alloys.

EXAMPLE 4

The test procedure used in Example 4 was as described in Example 3, but containing a commercially used corrosion inhibiting/anti-scaling formulation and sodium chloride in varying concentrations. The formulation used was typical of currently available all-organic treatments for use in open recirculating waters in that the treatment contained a blend of phosphonates, polymers and azoles. The formulation was used at the dosage level recommended for industrial usage for all tests. Sodium chloride was added in concentrations varying from 50 to 10,000 ppm. The results are shown in the following table:

| Test | TTPC (ppm) | NaCl Concentration (ppm) | Mild Steel Corrosion Rate (MPY) |
|---|---|---|---|
| 1 | 0 | 50 | 1.9 |
| 2 | 15 | 50 | 1.7 |
| 3 | 0 | 100 | 7.5 |
| 4 | 15 | 100 | 6.4 |
| 5 | 0 | 550 | 10.1 |
| 6 | 15 | 550 | 9.5 |
| 7 | 0 | 1050 | 10.3 |
| 8 | 15 | 1050 | 9.4 |
| 9 | 0 | 10,000 | 19.7 |
| 10 | 15 | 10,000 | 18.6 |

The results show that the increased corrosion inhibition effect of additions of cationic alkylphosphonium salts, specifically TTPC, with all-organic treated cooling waters is maintained over a large range of high dissolved solids containing waters, as would be encountered in actual aqueous cooling systems.

EXAMPLE 5

The test procedure for Example 5 consisted of the one time addition of 15 ppm of cationic alkyl-phosphonium salt, specifically TTPC, based on the total system volume to a pilot plant scale test rig containing a regulated water treatment level consistent in each of the following tests. Typical test conditions were as follows: Total Hardness=840 ppm as $CaCO_3$, M-alkalinity=110 ppm as $CaCO_3$, pH=8.2, Cl=200–500 as Cl). The formulation used was typical of currently available metal-based treatments for use in preventing corrosion and scaling of open recirculating waters in that the treatment contained a blend of phosphonates, polymers, and azoles, as well as inorganic metal salts for corrosion control. The formulation was used at the dosage level recommended for industrial usage for all tests. This level was the same in all the following tests. The corrosion rate of mild steel was measured using a Polarization Admittance Instantaneous Rate (PAIR) probe. The results are shown in the following table:

| Test | Corrosion Rate (MPY) Prior to TTPC Addition | Corrosion Rate (MPY) Following TTPC Addition |
|---|---|---|
| 1 | 7.0 | 5.2 |
| 2 | 9.4 | 5.7 |
| 3 | 8.3 | 6.4 |
| 4 | 7.0 | 6.8 |
| 5 | 6.7 | 6.5 |
| 6 | 15.0 | 14.0 |

-continued

| Test | Corrosion Rate (MPY) Prior to TTPC Addition | Corrosion Rate (MPY) Following TTPC Addition |
|---|---|---|
| 7 | 6.5 | 6.0 |
| 8 | 19.0 | 17.8 |
| 9 | 4.0 | 3.7 |
| 10 | 4.7 | 4.4 |

These tests show that the presence of a cationic alkylphosphonium salt, specifically TTPC, in pilot testing open recirculating cooling rig is effective inhibiting the corrosion of ferrous materials.

We claim:

1. A method for inhibiting corrosion of metals which are in contact with an aqueous system which comprises adding to the system, in a dosage range between 0.1 ppm to 500 ppm, a water soluble, cationic alkyl phosphonium salt having the formula:

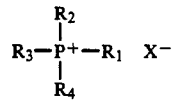

wherein $R_1$, $R_2$, $R_3$, and $R_4$ are each independently selected from the group consisting of $C_1$ to $C_{18}$ alkyl, $C_5$ to $C_7$ cycloalkyl or aryl, and wherein X is an anion selected from the group consisting of halide, alkosulfate, tosylate, carboxylate, sulfonate, sulfate, phosphate, phosphonate, acetate, or nitrate; monitoring the corrosion rate of the metals in the system, and if the corrosion rate is unacceptable, modifying the dosage of the cationic alkyl phosphonium salt to a dosage which effectively inhibits corrosion of the metals.

2. A method according to claim 1 wherein the metal is selected from the group consisting of copper, copper alloys, iron, and iron based metals.

3. A method according to claim 1 wherein $R_1$, $R_2$, and $R_3$ are independently selected from the group consisting of $C_1$ to $C_5$ alkyl.

4. A method according to claim 1 wherein the corrosion inhibition amount is in the range of 1 ppm to 100 ppm.

5. A method according to claim 1 wherein the corrosion inhibition amount is in the range of 2 ppm to 50 ppm.

6. A method according to claim 1 wherein the corrosion inhibition amount is in the range of 10 ppm to 20 ppm.

7. A method for inhibiting corrosion of metals which are in contact with an aqueous system which comprises adding to the system according to claim 1 wherein the water-soluble cationic alkyl phosphonium salt is N-tributyl tetradecyl phosphonium chloride.

8. A method according to claim 7 wherein the corrosion inhibition amount is in the range of 1 ppm to 100 ppm.

9. A method according to claim 7 wherein the corrosion inhibition amount is in the range of 2 ppm to 50 ppm.

10. A method according to claim 7 wherein the corrosion inhibition amount is in the range of 10 ppm to 20 ppm.

* * * * *